US006050423A

United States Patent [19]

Dunnuck et al.

[11] Patent Number: 6,050,423

[45] Date of Patent: Apr. 18, 2000

[54] TROMMEL WITH QUICK CHANGE SCREEN PANELS

[75] Inventors: Charles T. Dunnuck, Mohnton; Jonathan P. Prox, Richland, both of Pa.

[73] Assignee: Terex Corporation, Myerstown, Pa.

[21] Appl. No.: 09/122,802

[22] Filed: Jul. 27, 1998

[51] Int. Cl.[7] ..... B07B 1/49; B07B 1/00

[52] U.S. Cl. ..... 209/399; 209/363; 209/397

[58] Field of Search ..... 209/288, 284, 209/285, 286, 397, 399, 401, 403, 315

[56] References Cited

U.S. PATENT DOCUMENTS

| | | | |
|---|---|---|---|
| 2,121,371 | 6/1938 | Traylor . | |
| 3,352,418 | 11/1967 | Swallow . | |
| 4,361,239 | 11/1982 | Kumandan | 209/288 |
| 4,728,422 | 3/1988 | Bailey | 209/399 |
| 4,929,346 | 5/1990 | Si-Lin . | |
| 5,041,214 | 8/1991 | Gero et al. | 209/397 |
| 5,049,262 | 9/1991 | Galton et al. . | |
| 5,330,057 | 7/1994 | Schiller et al. | 209/401 |
| 5,372,261 | 12/1994 | Galton et al. | 209/399 |
| 5,437,374 | 8/1995 | Bills et al. . | |
| 5,507,396 | 4/1996 | Hauch | 209/399 |
| 5,816,413 | 10/1998 | Boccabella et al. | 209/399 |

FOREIGN PATENT DOCUMENTS

| | | | |
|---|---|---|---|
| 779427 | 7/1957 | United Kingdom | 209/397 |

*Primary Examiner*—Donald P. Walsh
*Assistant Examiner*—Daniel Schlak
*Attorney, Agent, or Firm*—James Creighton Wray; Meera P. Narasimhan

[57] ABSTRACT

Screen panels are arcuately distorted and wedged between lifter tubes inside of trommels for varying the orifice size, shape or distribution or repairing drum screen sections in trommel screen separators. In lieu of replacing screens on the drum framework, the drum is ordered with the largest screen opening for the anticipated application. Additional screen panels are inserted or laminated to the original drum screen to reduce or change screen openings and to produce the smaller fines. Because these small screen panels receive structural support from the drum screen, quick change screen panels can be fabricated out of many different frames, screening materials and screen opening sizes. In preferred embodiments, the smaller, lighter, framed screen panels are easily managed and quickly exchanged as required, reducing downtime and loss of production. Quick change screen panels have resilient arcuately bendable semi-rigid frames and are designed to be handled manually. These individual panels can be ordered in quantity to cover the entire trommel drum or any portion thereof, or panels may have different openings for a single drum, providing great flexibility to the operator to fine tune the screening operation.

39 Claims, 2 Drawing Sheets

TROMMEL WITH QUICK CHANGE SCREEN PANELS

BACKGROUND OF THE INVENTION

The present invention relates to trommel separators for screening material of different sizes. Specifically, the present invention relates to varying orifice size to produce the desired end product.

The use of trommels to screen particulate materials, or separate materials under a chosen size is well known. A trommel is a substantially cylindrical rotating screen drum that receives bulk materials with fines (small particles) for separation. The screen drum is rotated about its inclined cylindrical axis. Materials,is fed into an upper end. Fines fall through the rotating screen, and oversize materials move out through the open lower end. Axially extending members along the screen lift and mix the bulk materials. The force of gravity causes materials within the trommel to tumble. Particles smaller than the screen size fall through the screen openings and are separated. Trommels have reinforcing frameworks with spaced circular members to support their screen drums and prevent undue deformation and wear.

Screen opening sizes are selected by the end user to produce the desired end product. However, changing screen sizes by replacing screen cloth is labor intensive and time consuming, yielding an undesirable loss of production.

A need exists for a quick and inexpensive method or apparatus for varying screen size in trommels. There is a need for quick change screen panel lamination for trommel separators.

SUMMARY OF THE INVENTION

The present invention provides a method and apparatus for varying the screen size in a trommel separator. In lieu of unbolting the screen from the drum framework, the drum is ordered with the largest screen opening for the anticipated application. Additional screen panels are inserted and laminated on the original drum screen to reduce screen opening size and to produce the smaller fines product desired. Because the small screen panels receive structural support from the drum screen, quick change screen panels can be fabricated with many different frame and screen materials and screen opening sizes. In preferred embodiments, the smaller, lighter, framed screen panels are easily managed and quickly exchanged as required, reducing downtime and loss of production. Quick change screen panels have resilient, semi-rigid frames and are designed to be handled manually. These individual panels can be ordered in quantities to cover the entire trommel drum or any axial portion thereof, providing great flexibility to the operator to fine tune the screening operation.

A trommel separator has a cylindrical framework with lifting axially extending tubes or ribs creating a cylinder upon which a drum screen is attached. The screen has a plurality of holes for allowing particulate material less than a predetermined size to pass through the screen. A quick change screen panel lamination system uses quick change screen panels inside the drum screen to alter the opening size, shape or distribution. The panels are formed by securing with a rectangular frame a screening surface with holes that differ with the sizing holes of the drum screen.

The screen panels may be sized to fit between the lifting ribs. In preferred embodiments the frame material is semi-rigid, the panels may be secured by arcuately deforming the panels and inserting the panels between the lifting ribs. The restorative force of the panels between the lifting ribs secures the panels. Suitable frame materials include, but are not limited to, steel or plastic.

In preferred embodiments, additional transverse support members connect the top edges and the bottom edges of the screen panel frames. The additional support members are evenly spaced between the left and right edges of the screen panels.

The screen sizing holes determine the fines product produced. Where smaller fines product is desired, the screen panel sizing holes are smaller than the drum screen sizing holes. Alternately, the sizing holes of the quick change screen surface may be the same as the sizing holes of the drum screen to control the fines produced. Insertable screens may be wire or plastic panels which are plyable and moldable. Shapes or spaces of openings may be varied. When a drum screen is damaged between ribs, a screen panel overcomes that defect. Screen panels preferably lie against the drum screens. When desired, spacers may be used.

Fasteners may be used for securing the quick change panels to the drum screen. Wire ties, mechanical clamps, and bolts are suitable. In preferred embodiments, J-bolts secure the screen panels to the drum screen at random intervals.

Other methods of altering the fines product include installing the screen panels over only a portion of the drum screen. This would allow a large fines product separation and collection near the trommel outlet and a separate small fines collection near the inlet. Alternatively, the panels may cover the entire drum screen and yield a uniform fines product.

The invention provides quick change screen panels used in trommels.

Trommel drums are designed as a structural framework, then dressed with a heavy duty woven wire screen cloth with high strength bolt fasteners. This screen cloth is typically steel with a 0.192 wire size or larger, pre-rolled to conform to the framework. Various screen opening sizes are selected by the end user to produce the desired end product. Changing screen sizes by replacing screen cloth is labor intensive and time consuming, yielding an undesirable loss of production and down time.

The invention is a replaceable screen panel system for changing screen sizes in a trommel particle separator. A drum screen with the largest opening size for the anticipated application is installed on a trommel. When smaller fines are desired, screen sets with varied smaller sizes are inserted within the drum to change the sizes of the fines. The small, light quick change screen panels have frames which are deformed as cylindrical sectors with reduced radii to fit inside the drum framework between lifting tubes. Releasing the screen panels allows them to spring outward, with the curved anchoring the panels against the drum screen between the lifters. The screen panels can cover the entire drum surface or any part of it. That reduces the time and labor necessary to fine tube the screening operation. The additional screens are fastened to the drum by J-bolts in a random pattern.

These and further and other objects and features of the invention are apparent in the disclosure, which includes the above and ongoing written specification, with the claims and the drawings.

DETAILED DESCRIPTION OF THE DRAWINGS

Figure 1A:
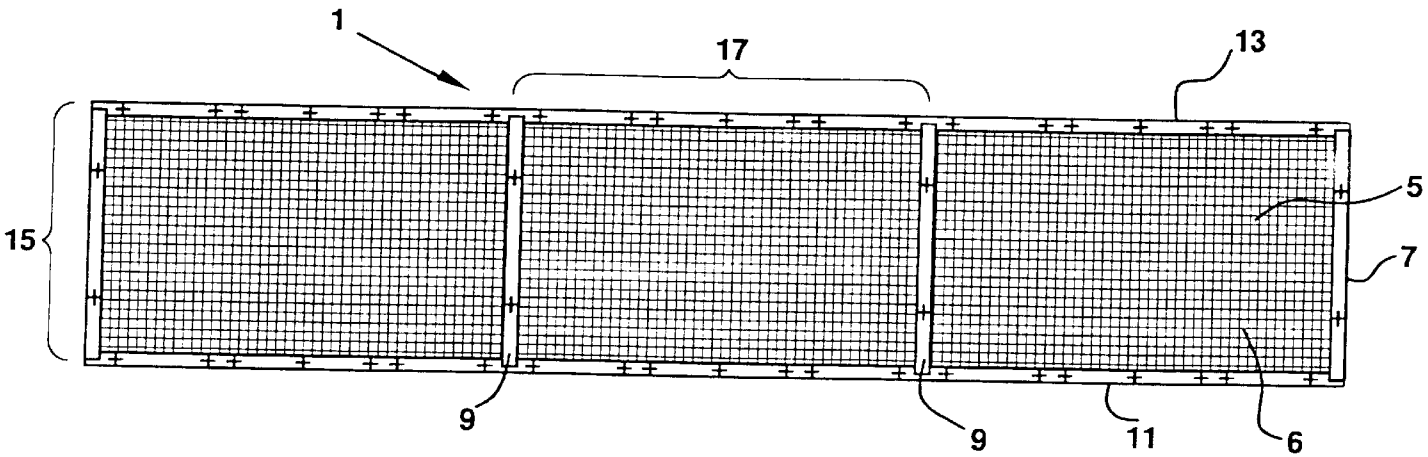
FIGS. 1A and 1B are plan views of quick change screen panels.
Figure 1B:
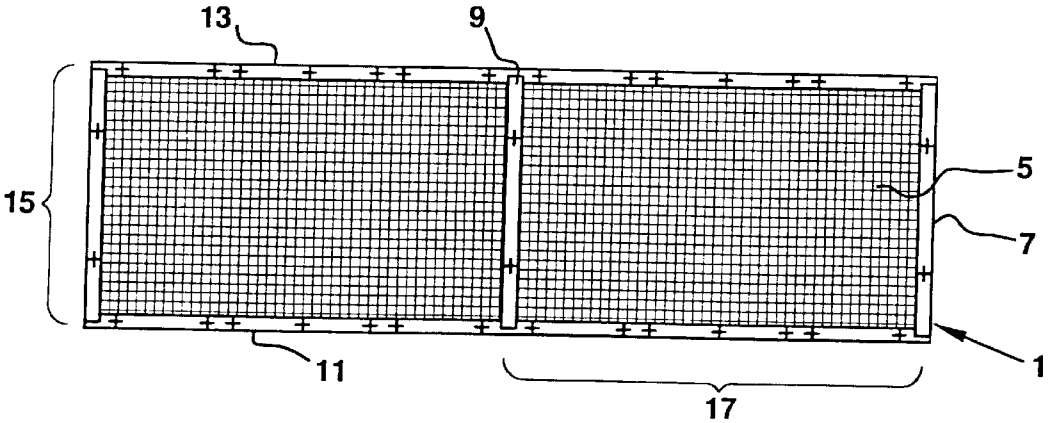

FIGS. 1A and 1B show plan views of a three and two panel quick change screen panels 1, respectively. A quick change screen surface 5 has a sizing holes 6 to allow material less than a predetermined size to pass through it. A rectangular frame 7 surrounding the screening surface supports the screening surface. In preferred embodiments additional members 9 run from the bottom edge 11 to the top edge 13 of the quick change screen panel 1 for added support, creating two and three panel screens. The width 15 of the screen panels equals the circumferential distance between the lifting tubes of the trommel screen separator. The length 17 of the screen panels equals the longitudinal distance between circumferential frame members. To reduce screen opening size and produce smaller fines product, the screen panels are inserted between the lifting tubes inside the drum screen.

Figure 2:
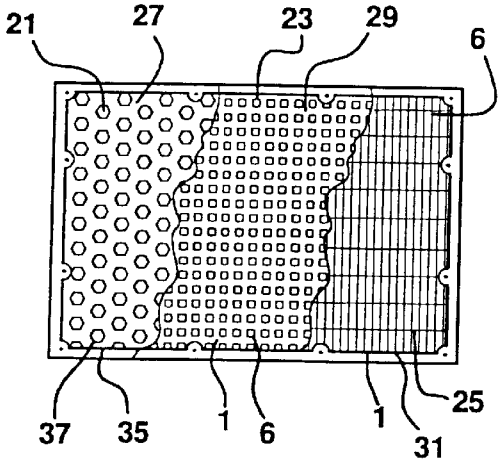
FIG. 2 shows partial elevational views of alternate quick change screen panels.

FIG. 2 shows partial elevational views of quick change panels. Sizes and styles of screen openings 21, 23 and 25 may vary. Screens 27, 29 and 31 may be made of differing material. Holes 21 may be molded or punched in a plastic sheet screen 27, for example, holes 23 may be punched in a metal screen 29. Alternatively, a screen 31 may be woven with wire in a unique pattern 25. To produce smaller fines product, the screen panels 1 with smaller openings 6 are laminated on top of the drum screen. Screen opening style may be varied.

Figure 3:
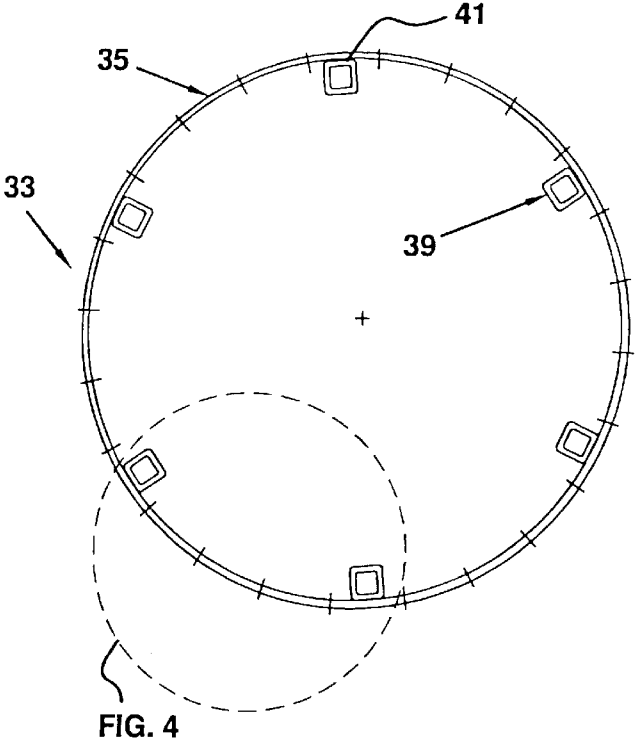
FIG. 3 is a transverse cross-section of a trommel drum framework and drum screen.

FIG. 3 shows cross-section of a trommel drum 33 with framework 39 and drum screen 35. A cylinder is formed by a drum framework of cylindrical supports bolted or welded to equally spaced lifting tubes 41. A drum screen 35 is attached to the outside of the drum frame work 39.

Figure 4:
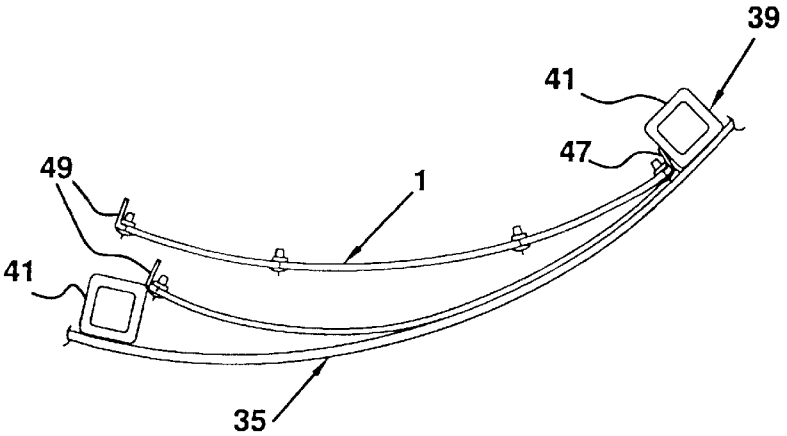
FIGS. 4 and 5 are partial transverse cross-sectional details of the insertion of a quick change screen panel into the trommel.

FIG. 4 shows the insertion of a quick change panel 1 into the trommel. A quick change panel is pressed between two lifting tubes 41 of the drum framework 39. In preferred embodiments, the screen panels are secured by mechanical fasteners such as J-bolts 45 placed in a random pattern.

As shown in FIG. 4, the screen panel 1 is inserted by placing a first longitudinal edge 47 of the screen panel 1 in the intersection between the trommel screen 35 and a lifting tube 41.

The opposite, second longitudinal edge is urged toward the first edge, arcuately deforming the screen until the second edge fits within the adjacent lifting tube 41.

Figure 5:
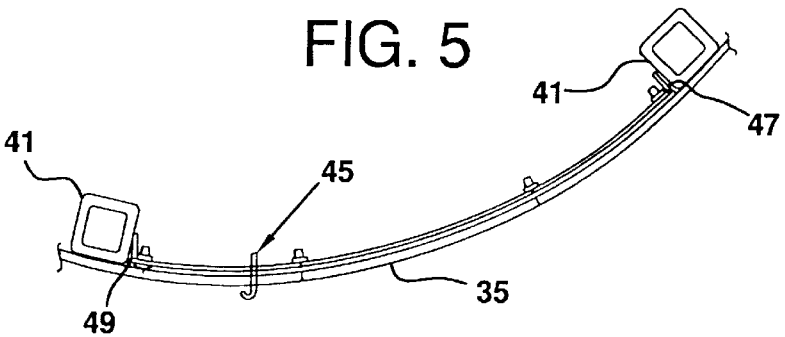

FIG. 5 shows the screen panel 1 tightly held against the drum screen 35 by the lifting tubes 41. The lifting tubes entrap and hold screen 1 circuately deformed against the trommel screen 35, preventing dislodgement until intentionally removed by pulling inward on one longitudinal edge of the screen panel. J-bolts 45 are added around edges of the screen panels for additional security.

While the invention has been described with reference to specific embodiments, modifications and variations of the invention may be constructed without departing from the scope of the invention, which is defined in the following claims.

We claim:

1. A quick change screen panel lamination system comprising:

a trommel separator comprising cylindrical members with lifters equally spaced longitudinally extending between the cylindrical frames and a drum screen attached outside of the lifters, the drum screen having a plurality of sizing holes for allowing particulate material less than a predetermined size to pass through the drum screen; and a plurality of quick change screen panels for removably laminating on the drum screen for altering opening sizes, each screen panel comprising a quick change screen surface having a plurality of screen panel sizing holes, and a support for supporting the screen panel and releasably securing the screen panel to the trommel; wherein the sizing holes of the drum screen differ from the sizing holes of the quick change screen panels.

2. The system of claim 1, wherein widths of the screen panels equal circumferential distances between the lifters and lengths of the screen panels equals longitudinal distances between the cylindrical members for allowing insertion of the screen panels between the lifters inside the drum screen for reducing screen opening size and producing smaller fines.

3. The system of claim 1, wherein the screen panel frames further comprise first and second opposite longitudinal edges and support members connecting the first edges and the second edges for providing additional support to the panel screens.

4. The system of claim 3, wherein the support members are evenly spaced between opposite transverse end edges of the screen panels.

5. The system of claim 1, wherein the screen panels further comprise resilient semi-rigid frames.

6. The system of claim 5, wherein the resilient semi-rigid frames are plastic.

7. The system of claim 5, wherein the resilient semi-rigid frames are steel.

8. The system of claim 1, wherein the sizing holes of the quick change screen panels are smaller than the sizing holes of the drum screen.

9. The system of claim 1, wherein the sizing holes of the quick change screen surface are shaped differently than the sizing holes of the drum screen.

10. The system of claim 1, further comprising fasteners for securing the quick change panels to the drum screen.

11. The system of claim 10, wherein the fasteners are a plurality of wire ties.

12. The system of claim 10, wherein the fasteners are a plurality of mechanical clamps.

13. The system of claim 10, wherein the fasteners are a plurality of bolts.

14. The system of claim 13, wherein the bolts are J-bolts.

15. The system of claim 10, wherein the fasteners are positioned irregularly over the drum screen and screen panels.

16. The system of claim 1, wherein the screen panels line only a portion of the drum screen.

17. The system of claim 1, wherein the screen panels line the entire surface of the drum screen.

18. The system of claim 1, wherein screen panels having a first opening size line a first axial portion of a drum screen near a trommel intake.

19. The system of claim 18, wherein screen panels having a second larger opening size line a second axial portion of the trommel further from the intake.

20. The system of claim 1, wherein the supports comprise resilient frames surrounding the screen panels for resiliently arcuately deforming the frames and screen panels in curvatures with radii less than radii of the drum screen for insertion of the screen panels between adjacent lifters and for releasing the screen panels to lie along the drum screen anchored by the lifters.

21. A quick change screen panel lamination method comprising:

providing a trommel separator comprising a cylindrical framework with equally spaced longitudinally extending lifters and a drum screen attached outside of the lifters, providing a plurality of sizing holes in the drum screen for allowing particulate material less than a predetermined size to pass through the drum screen;

providing a plurality of quick change screen panels, the quick change screen panels having a plurality of sizing holes, wherein the sizing holes of the drum screen differ from the sizing holes of the quick change screen panels, providing on the screen panels rectangular frames for supporting and securing the screen panels; and laminating the screen panels to the inside of the drum screen and altering trommel screen opening sizes.

22. The method of claim 21, wherein the providing a plurality of screen panels comprises providing a plurality of screen panels with widths of the screen panel equaling circumferential distances between the lifters and for positioning the screen panels between the lifters inside the drum screen and thereby reducing screen opening size and thereby producing smaller fines, and wherein the laminating further comprises distorting and inserting the screen panels between the lifters inside the drum surface.

23. The method of claim 21, wherein providing a plurality of screen panels further comprises providing screen panels with transverse support members for connecting opposite longitudinally extending edges of the screen panel frames for providing support to the screen surface and maintaining the screen panels distorted between the lifters.

24. The method of claim 23, wherein providing the support members comprises providing support members evenly spaced between opposite transverse end edges of the screen panels.

25. The method of claim 21, wherein providing screen panel frames comprises providing semi-rigid frames.

26. The method of claim 25, wherein providing semi-rigid frames comprises providing plastic frames.

27. The method of claim 25, wherein providing semi-rigid frames comprises providing steel frames.

28. The method of claim 21, wherein the providing a quick change screen panels comprises providing quick change screen surfaces having sizing holes smaller than the sizing holes of the drum screen for reducing screen opening size and producing smaller fines.

29. The method of claim 21, wherein the providing a quick change screen panels comprises providing quick change screen panels with sizing holes shaped differently than sizing holes of the drum screen for altering screen opening shapes and producing differently selected fines product.

30. The method of claim 21, further comprising providing a plurality of fasteners for securing the quick change panels to the drum screen; and securing the quick change panels to the drum screen with the fasteners.

31. The method of claim 30, wherein the providing a plurality of fasteners comprises providing a plurality of wire ties.

32. The method of claim 31, wherein the laminating the screen panels to the drum screen comprises laminating the screen panels to cover only a portion of the drum screen.

33. The method of claim 31, wherein the laminating the screen panels to the drum screen comprises laminating the screen panels to cover an entire surface of the drum screen.

34. The method of claim 30, wherein the providing a plurality of fasteners comprises providing a plurality of mechanical clamps.

35. The method of claim 30, wherein the providing a plurality of fasteners comprises providing a plurality of bolts.

36. The method of claim 35, wherein providing a plurality of bolts comprises providing a plurality of J-bolts.

37. The method of claim 30, wherein the securing the quick change panels to the drum screen with the fastener comprises securing the panels to the drum screen by positioning the fasteners irregularly between the drum screen and the panels.

38. Drum screen panels for trommels having cylindrical drum screens and cylindrical frameworks with longitudinally and inwardly extending lifters, comprising screen panels having generally rectangular arcuately resiliently distortable frames with panel screens extending across the frames for resiliently distorting and curving the screen panels and inserting the screen panels between adjacent lifters for holding the screen panels radially outward against the cylindrical drum screens.

39. The drum screen panels of claim 38, wherein the panel screens have openings differing in size, shape or distribution from openings in the drum screen.

* * * * *